US007043862B2

(12) United States Patent
Franks

(10) Patent No.: US 7,043,862 B2
(45) Date of Patent: May 16, 2006

(54) HAND CARRIER FOR A LONG ARM FIREARM

(76) Inventor: Virgil P. Franks, P.O. Box 21, Paonia, CO (US) 81428

( * ) Notice: Subject to any disclaimer, the term of this patent is extended or adjusted under 35 U.S.C. 154(b) by 0 days.

(21) Appl. No.: 10/754,839

(22) Filed: Jan. 12, 2004

(65) Prior Publication Data

US 2005/0183319 A1 Aug. 25, 2005

(51) Int. Cl.
*F41A 23/00* (2006.01)

(52) U.S. Cl. ..... 42/94

(58) Field of Classification Search ..... 42/85, 42/90, 106, 94; 224/149, 150, 913; 24/2.5; 248/683, 689; D3/259
See application file for complete search history.

(56) References Cited

U.S. PATENT DOCUMENTS 736,632 A * 8/1903 Priddat ..... 294/171
1,460,354 A * 6/1923 Carver ..... 294/170
2,023,098 A * 12/1935 Poyer ..... 294/171
2,503,544 A * 4/1950 Clore ..... 206/435
2,705,988 A * 4/1955 Schulte ..... 383/28
3,114,487 A * 12/1963 Miller et al. ..... 294/147
4,615,155 A * 10/1986 Chamberlain ..... 52/91.1
4,829,999 A * 5/1989 Auth ..... 606/1
D376,473 S * 12/1996 Franks ..... D3/262
6,135,310 A * 10/2000 Svehaug ..... 220/700
2002/0020040 A1* 2/2002 Gallup ..... 16/425
2004/0145196 A1* 7/2004 Katz ..... 294/1.4
2004/0244169 A1* 12/2004 Crawley ..... 29/402.08

* cited by examiner

*Primary Examiner*—Troy Chambers
(74) *Attorney, Agent, or Firm*—Edwin L. Hartz

(57) ABSTRACT

A hand carrier for long arm firearms having a handle and a single strand of wire bent to form two saddles to grip and support the firearm with an open section of the wire detachably attached to the handle and a straight-line of the wire being held in the handle for a closed carrying position and removed from the handle for an open position for inserting or removing the firearm.

6 Claims, 5 Drawing Sheets

HAND CARRIER FOR A LONG ARM FIREARM

BACKGROUND OF THE INVENTION

1) Field of the Invention

This invention relates to the easy, less fatiguing carrying of a long arm firearm (rifle, shotgun, or muzzle loader), and, more particularly, to an easy-to-use carrier having two cooperating members for cradling and securely holding a long arm firearm and a handle for holding the carrier.

2) Related Art

Slings have been employed with hand-carried firearms by both hunters and military personnel for many years. The purpose of such devices is to relieve the bearer from the burden of carrying the long arm firearm (normally a rifle) with his arms except during those periods of time in which it is anticipated that the firearm will be used, or is actually being used. The conventional sling, although permitting the firearm bearer to do other things with his hands, does not permit access to the firearm quickly in a combat or hunting situation. Thus, the conventional sling, a flexible strap connected at the forward end of the firearm to a terminal and to a terminal at the gun stock end (normally on the underside of the rear portion of the stock) permits the firearm to be either suspended from one shoulder of the bearer or to be carried diagonally across the back of the firearm bearer. In the event that the firearm must be aimed and discharged quickly, both of the above-described carrying positions require time to reorient the firearm, time which may not be available. These manipulations are made additionally cumbersome when the bearer is wearing thick or heavy clothing or is restricted in his movement by his surroundings. Also, the barrel of the firearm being carried, unless extremely short, tends to catch on vegetation and other impediments to travel, causing undue crouching and maneuvering by the bearer. In addition, contact with any impediment creates unwanted sound.

Another problem with conventional slings is that they normally must be adjusted to fit both the firearm and the bearer, thus precluding rapid change in use to another firearm or use by another bearer.

Typically, when the bearer of a firearm anticipates that discharge is imminent, he ceases using the sling and carries the firearm diagonally across his chest with one hand on the forearm of the stock and the other hand on the grip of the butt stock. Should the need to discharge the firearm lessen, but still be likely, the bearer will use the one-hand carry. However, the unaided across-the-chest carry and the unaided one-hand carry are very fatiguing.

An attempt to address these problems of the conventional sling has been made by a device disclosed in U.S. Pat. D346,473 to Virgil Franks, the inventor of the carrier of this application. This patent discloses a device that has a handle permanently attached to a cradle which supports the firearm being carried. However, it has been found that the design suffers from several disadvantages.

The cradle, having a front member and a back member that are permanently attached to the handle, cannot be easily repaired.

The handle being made of two pieces requires more handling and machining than a one-piece handle. If the handle is made of wood, considerable loss will occur during production of the handle pieces because of irregularities and defects in lumber stock and difficulty in machining to the necessary tolerances of the design. If molded from plastic material or other material, the cost of the handle increases.

Although, not evident from the patent, it has been found that the attaching and detaching of the carrier of the design shown in the patent requires considerable practice to avoid pinching of the fingers.

SUMMARY OF THE INVENTION

In accordance with the present invention, a hand carrier for a long arm firearm comprises an elongated, cylindrical handle attached to a grasping cradle. The handle is made of one piece of hard material grooved and drilled to permit releasable attachment to the grasping cradle. The grasping cradle has a front and back section, both of which are U-shaped at the bottom to securely hold the long arm firearm. These sections are joined to a straight-line section and open section in forming the cradle. The front and back members have a right and left side that are essentially symmetrical about a centerline through the U at the bottom and middle of the cross-section of the handle at the top. In the closed position, the only visible deviation in symmetry is the greater height of the right side of the front and back members. This greater height allows the overlap of the straight-line right side section over the open left side section.

The open left-side section is held in place in the handle by a bushing, washer, and screw at the front of the handle and by another bushing, washer and screw at the back of the handle. The straight-line right-side section is guided into a longitudinal slot in the handle by the washers at the front and back ends of the handle.

In addition, the front and back members of the cradle are covered by protective sleeves of rubber, plastic or other materials. These sleeves may be easily replaced.

The design of the hand carrier of this invention results in a carrier that is tight in weight and easily repaired. Further the operation is improved and there is no pinching of fingers when the carrier is being attached to a long arm firearm or being removed therefrom.

Objects, features and advantages of this invention will be come apparent from a consideration of the foregoing and the following description, the appended claims and the accompany drawing.

DESCRIPTION OF PREFERRED EMBODIMENTS

Figure 1:
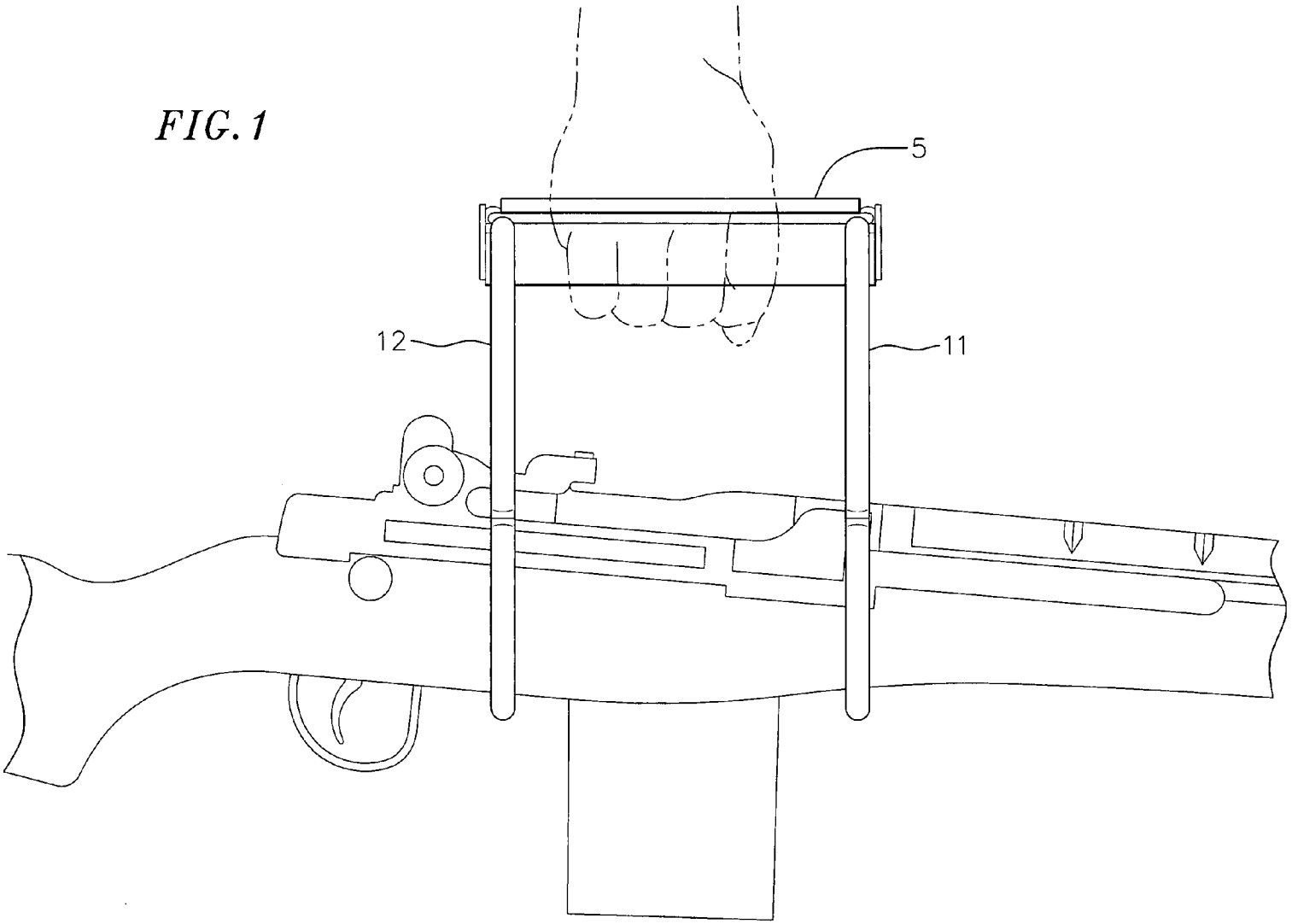
FIG. 1 is a left side elevation view of the carrier of this invention in use.

For purposes of describing the invention. a rifle will be used as the long arm firearm to be carried. Also with reference to the drawings, particularly FIG. 1 thereof, the end of the carrier nearer the barrel of the rifle is designated for purposes of illustration and description the front of the carrier. The end of the carrier nearer to the stock of the rifle is the back of the carrier.

Figure 3:
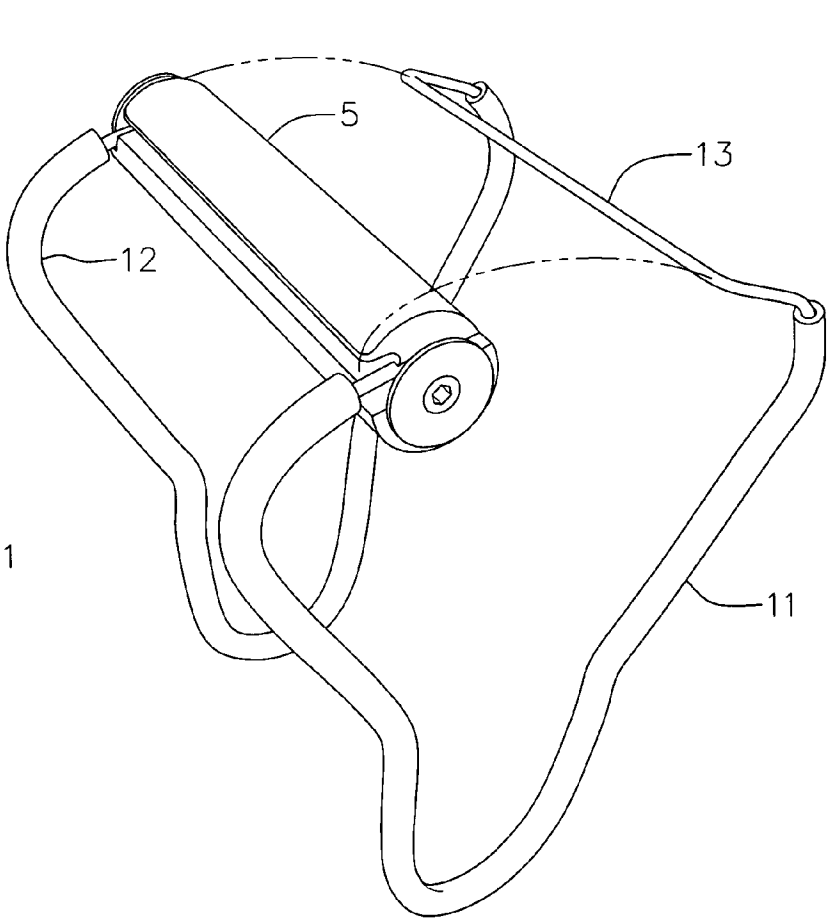
FIG. 3 is a perspective view from the left front of the carrier in its open position in accordance with this invention.
Figure 5:
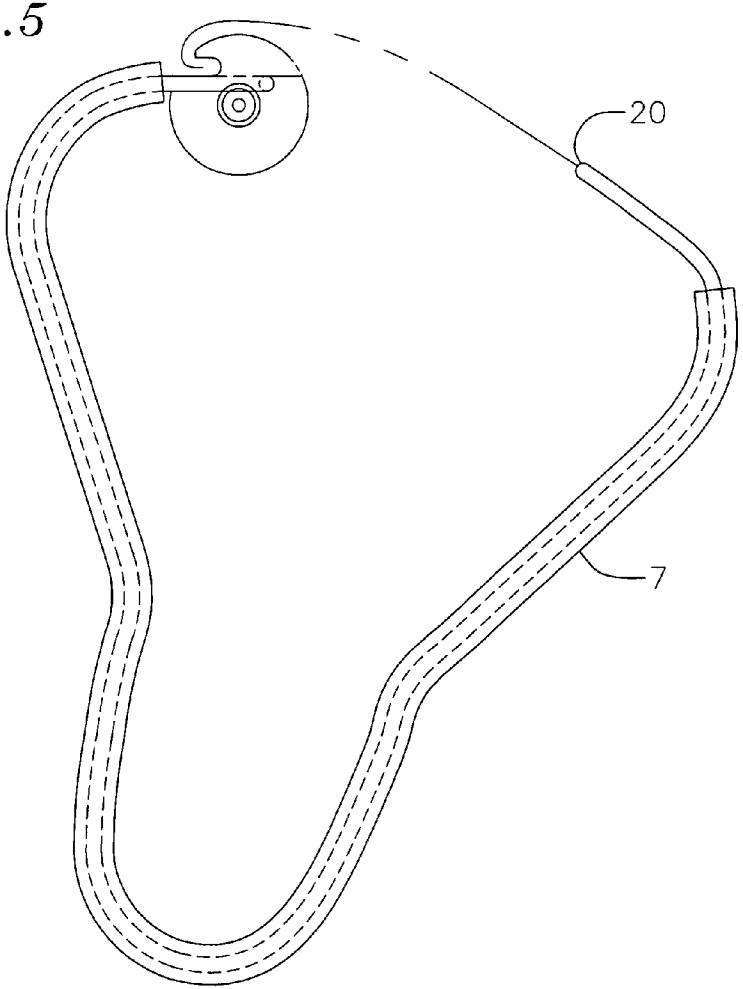
FIG. 5 is a front elevation view of the carrier in its open position without the securing means in accordance with this invention.

The bottom of the carrier is U-shaped and is configured to cradle and to hold a rifle. The top of the carrier has a handle for carrying a rifle in the carrier. When in use, the carrier is in a closed position, as shown in FIGS. 1, 2, 4 and 9. To remove a rifle or to insert a rifle the carrier is in an open position, as shown in FIGS. 3 and 5. The carrier is held in the open position by the spring action of the wire body or frame of the carrier. To place the carrier in the closed position, one side of the carrier is forced toward the other side of the carrier and locked into the closed position.

Figure 8:
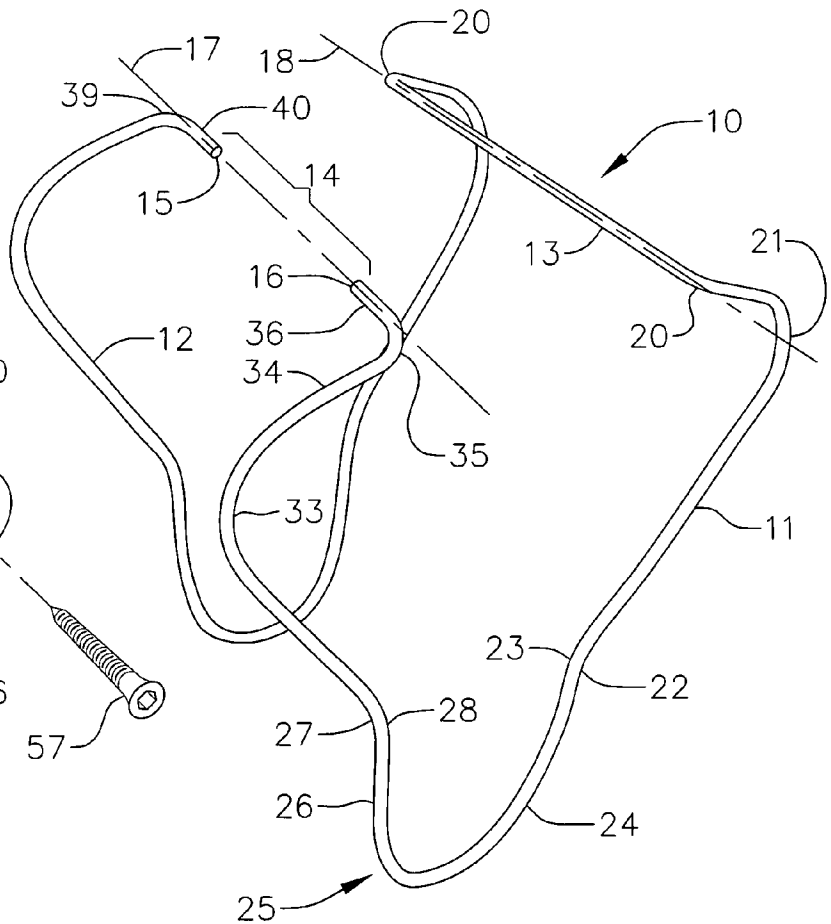
FIG. 8 is a perspective view from the left front of the spring wire body of the carrier in accordance with this invention.

The carrier of this invention is best understood by considering sections of the body, initially separate from the handle. Advantageously, the sections are all part of one body 10 as shown in FIG. 8. The body 10 is preferably made of a continuous (single piece) ⅛-inch spring steel wire.

The sections of the body 10 (as best seen in FIG. 8) are a front section 11, a back section 12, a straight-line section 13 along a centerline 18 and the two ends of the body opposed and aligned on a center line 17 to form an open section 14.

The open section 14 consists of a first end 15 and a second end 16 and the continuous wire body 10 opposed and spaced apart on a common centerline 17. End 15 is bent toward end 16 and the two ends lie on centerline 17 which is parallel to centerline 18 of the straight line-section 13.

Figure 2:
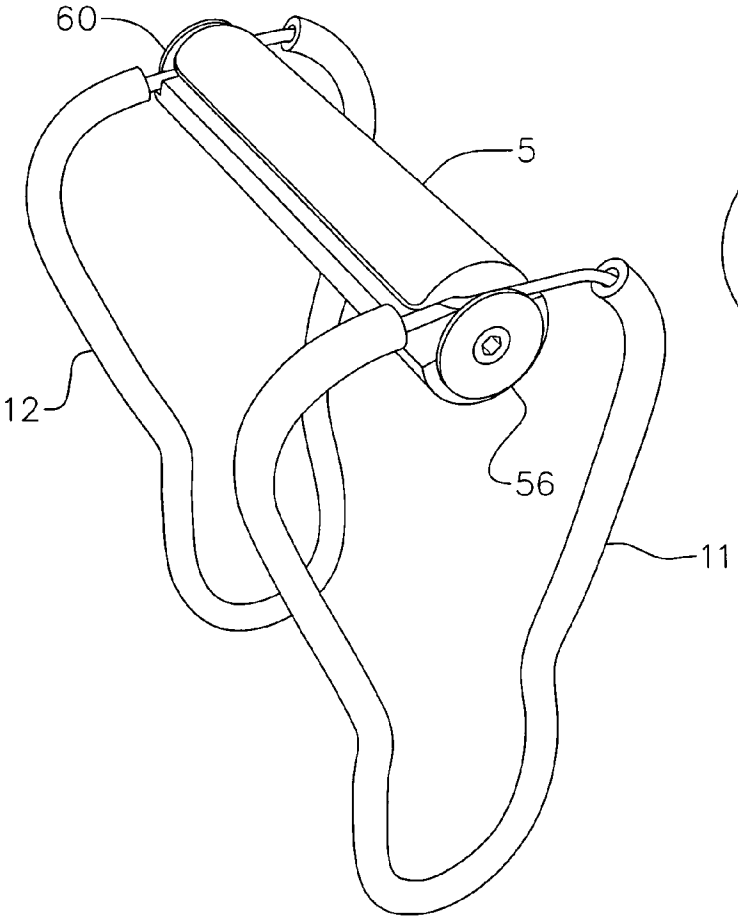
FIG. 2 is a perspective view from the left front of the carrier in its closed position in accordance with this invention.

The front section 11 is formed between the straight-line section 13 and the open section 14 as follows and as best seen in FIG. 8:

The wire of body 10 has a first bend 20 at a right angle to the centerline 18 of the straight-line section 13 to join the front section 11 and the section 13. The wire progresses from the first bend 20 to a second bend 21, which gently curves the wire downwardly. The section 13 is at the top of the carrier, as seen in FIGS. 2 and 3. The wire continues in a downwardly direction to a third bend 22. This bend 22 is a triple bend and results in an inwardly extending dimple 23 on the right side of the front section 11 to aid in gripping the rifle and in increasing the spring tension of the body 10. The wire continues downwardly from bend 22 to form the first leg 24 of a U-shape 25. At the bottom of the carrier the wire of body 10 is bent into a U-shape 25 to cradle the rifle. The wire extends upwardly to form a second leg 26 of the U-shape 25 and continues upwardly to a fourth bend 27. Bend 27 is also a triple bend that creates an inwardly extending dimple 28 on the left side of the front section 11 that cooperates with dimple 23 on the right side to securely hold a rifle. The wire continues upwardly from the fourth bend 27 and to the left to form a space above the U-shape that has a width 30 (FIG. 4) that is greater than the width 31 (FIG. 4) across the U-shaped portion 25 between the legs 24 and 26. This greater width 30 provides a large opening when the carrier is in its open position for inserting the rifle into the carrier.

The wire continues upwardly to a sixth bend 33 where the wire curves to the right toward the open section 14. The wire continues toward the open section 14 to a seventh bend 35. Bend 35 is a right angle bend toward the back of the carrier and joins front section 11 and open section 14. The wire continues beyond bend 35 a short distance (about ⅞ inch) to form a leg 36 ending at the second end 16 of the wire.

The resulting front section 11, when the carrier is in its closed position, has a right side and a left side essentially symmetrical about a centerline through the bottom of U-shape and the center of the handle 5.

The width 30 of the upper space is 3⅝ inches and the width 31 across U-shape 25 is 1⅝ inches for a carrier designed for a hunting rifle of 30–06 caliber and rifles of similar caliber. The overall height of the carrier is 8¼ inches and the overall length is 6 inches. These dimensions will vary depending upon the long arm firearm to be carried.

The back section 12 has the same bends in the wire and U-shape at the bottom as the front section 11. For ease of reference, the elements of the back section have the same numbers as the elements of the front section except for a seventh bend 39. Bend 39 of the back section causes the wire to bend toward the front of the carrier with a short leg 40 extending along the same centerline 17 as leg 36. Leg 40 (also about ⅞" long) stops at the first end 15. The distance between the first end 15 and the second end 16 when secured in the handle 5 is about 3¼"-inches.

The straight-line section 13 joins the front section 11 and the back section 12 on the right side of the carrier at the top of the carrier.

The wire of the body 10 forming the front section 11 and the back section 12 is best encased in a rubber sleeve 7 (FIGS. 4 and 5) to cushion the rifle in the carrier. The sleeve 7 may be made of material other than rubber that will cover the wire and cushion and protect the rifle from abrasion by the wire body 10.

A handle 5 completes the carrier of the wire body 10, and sleeves 7, with means for securing the front and back sections in the handle 5.

Figure 6:
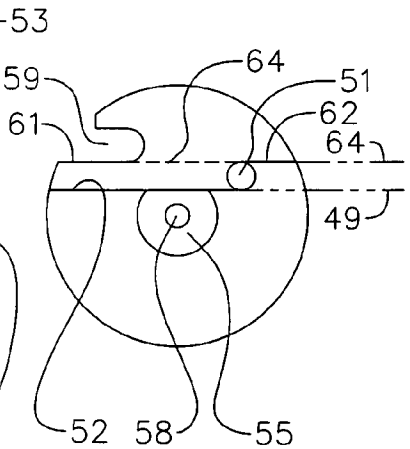
FIG. 6 is a front elevation view of the handle of the carrier in accordance with this invention.
Figure 7:
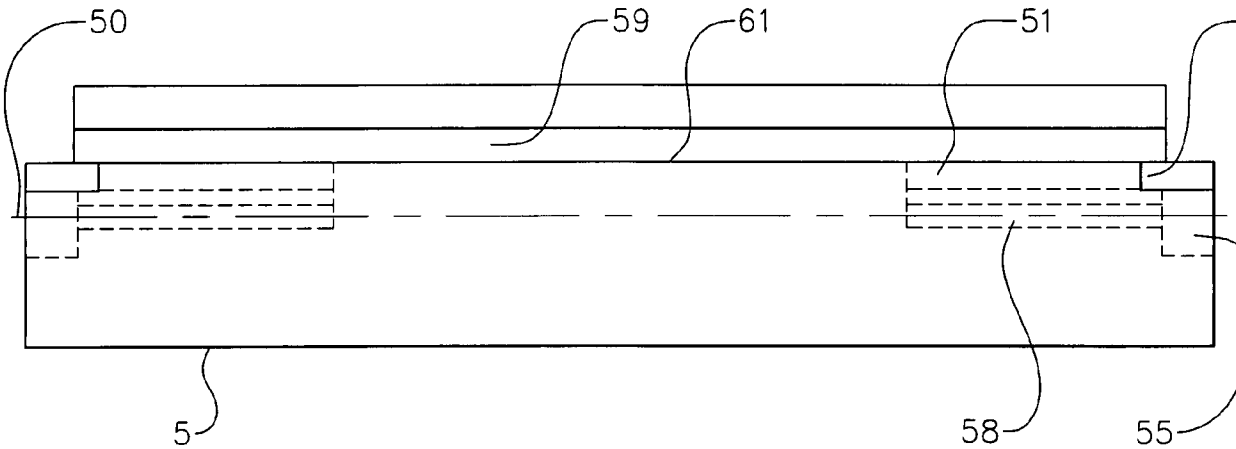
FIG. 7 is a left side elevation view of the handle in accordance with this invention.

Handle 5 will be described with reference to the front end shown in FIGS. 2–5, with the wire body 10, and with reference to the front elevation view of FIG. 6 and the left side elevation view in FIG. 7, without the wire body in place. The same description applies to the rear end of the handle 5.

Figure 4:
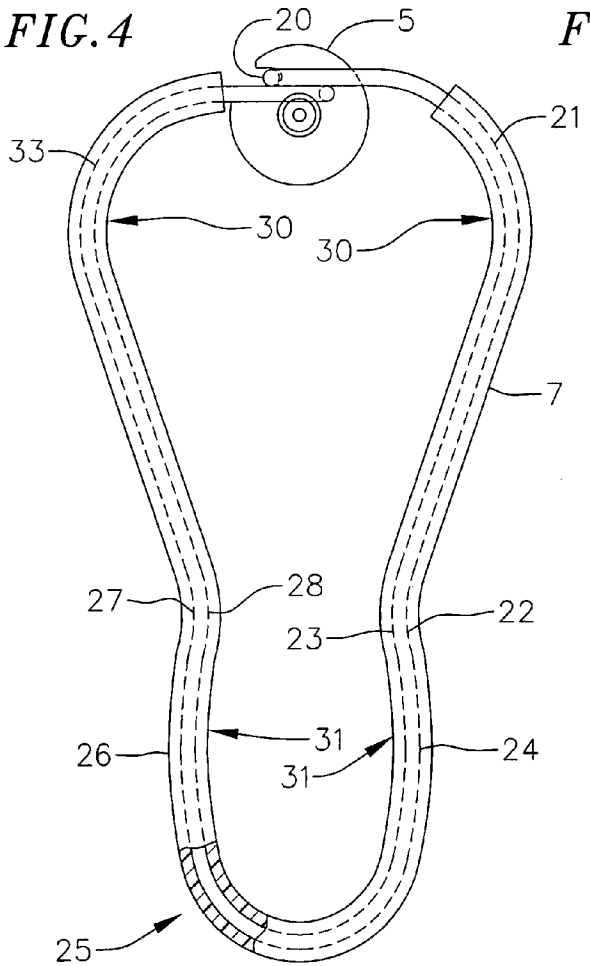
FIG. 4 is a front elevation view of the carrier in its closed position without the securing means of a washer and screw in accordance with this invention.
Figure 9:
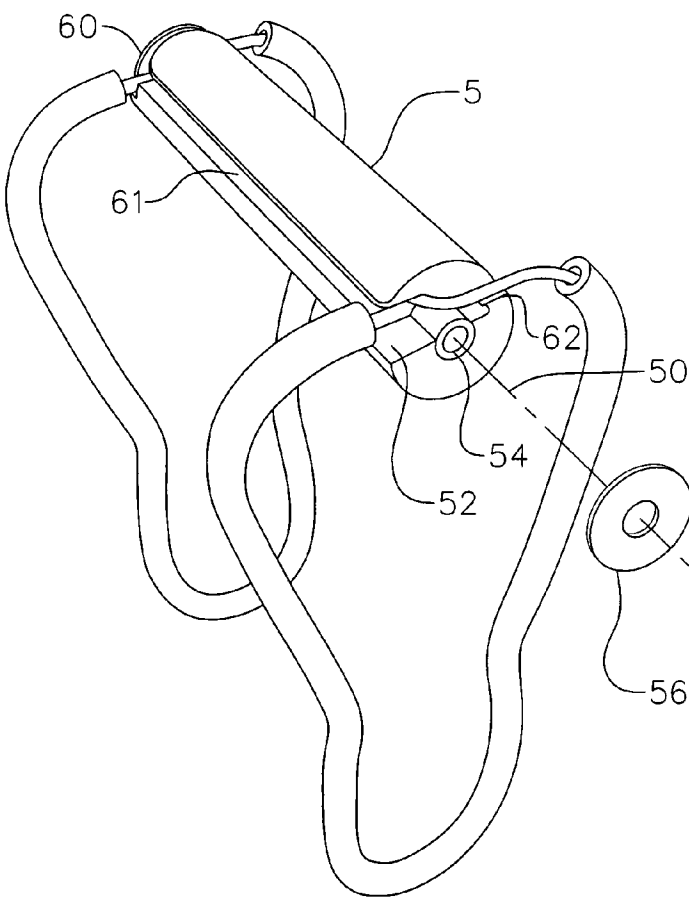
FIG. 9 is a perspective view from the left front of the carrier showing an exploded view of the securing means on the front end in accordance with this invention.

The handle 5 is cylindrical in shape and is preferably made of wood or some other hard durable material. It is 6 inches in length and 1¼ inches in diameter. A first hole 51 is provided to receive the second end 16 and leg 36 of the wire body 10. The wire adjacent bend 35 and going into bend 33 is straight (portion 34 between bends 33 and 35). A first shelf 52 is provided in the handle 5 along a chord 49 ⅛$^{th}$ inch from the center of the circular cross-section of the handle 5 for this part of the wire. This is seen best in FIGS. 6 and 9. Shelf 52 extends longitudinally into the handle 5 to a wall 53 to permit the wire of leg 36 near bend 35 to rest on shelf 52 with the end 16 of leg 36 extending longitudinally into the handle 5. The inner wall 53 is at a sufficient depth to permit the straight-line section 13 to pass over the top of the open section 14 (and specifically legs 36 and 40) at bends 35 and 39 when positioned in the handle 5. This is seen in FIGS. 4 and 9. A second shelf 61, parallel to the first shelf 52, and on a parallel chord 64 ⅛$^{th}$ inch from the longitudinal center of the circular cross-section of handle 5, is created by a longitudinal cut or slot 59.

A third shelf 62 on the same chord 64 as shelf 61 is provided on the end of the chord opposite slot 59. This shelf 62 is a short shelf at each end of the handle and is a rest for the wire at the end of the straight-line section 13 near bend 20 at the front and back of the carrier. Shelf 62 extends from hole 51 to the outer periphery of handle 5 and is ⅜ inch in length.

The front section 11 at the bend 35 is held in place in handle 5 by a bushing 54 (see FIG. 9). The bushing 54 centered on the longitudinal center line 50 of handle 5 is cylindrical in shape and is metallic. The bushing has a ⅜-inch outside diameter and is ¼ inch long. A counter-sunk hole 55 in the end of the handle 5 accommodates the bushing 54. The second end 16 and the wire beyond bend 35 are held in place by bushing 54 and a washer 56 and a screw 57, both of which are also centered on the centerline 50 of handle 5. (See FIG. 9) The first end 15 and wire near the bend 39 on the back end are similarly held in place by a washer 60 and screw (not shown).

The bushing 54 holds the wire against inner wall 53. The bushing is held against the wire near bend 35 by the washer 56 and screw 57, which is screwed into a receiving hole 58 along the longitudinal axis of handle 5.

A shallow slit 59 is cut the length of the handle 5 along and above a chord 64 that is parallel to the chord of the first shelf 52. The depth of the slot 59 is sufficient to receive the diameter of the wire of the straight-line section 13 and to hold it in place. This is best seen in FIG. 4 with the washer 56 and screw 57 removed.

The front section 11 and the back section 12 are guided and held in place inside washer 56 at the right end and a similar washer 60 at the left end.

The dimensions given herein are not to be limiting, but are for illustrative purposes only. The sizes may be greater or smaller and still result in a carrier within the scope of this invention. The dimensions given are for a carrier that was designed for a hunting rifle like a 30–06 caliber rifle.

For purposes of describing the use of the invention, a rifle will be used as the long arm firearm to be carried.

To attach the one-hand carrier first, without exception, carefully inspect the rifle to see that it is unloaded and there are no obstructions in the barrel. Secondly, place the rifle with it longitudinal axis approximately parallel to the user's chest with the butt stock against a firm surface. Continuing, with one hand on the forepart of the rifle, to the rear of the muzzle, hold the rifle at an upward angle approximately forty-five degrees to the horizontal. With the other hand, grasp the handle 5 of the carrier and reach over and across the rifle. Place the carrier beneath the rifle so that U-shape of back section 12 will be positioned firmly, approximately ¾ inch in front of the trigger guard. (Also this will position the front section 11 correctly.) Adjust the plane of the vertical axis of the carrier so that it will be on the plane of the vertical axis of the rifle. (This will ensure that there will be equal clearance on both sides of the rifle sighting equipment adjacent to the carrier.)

While continuing to hold the carrier against the bottom of the rifle, remove the other hand from the forepart of the rifle and place the hand in a transverse squeezing position across the top of back section 12. At this point, squeeze sections 11 and 12 until straight-line section 13 rides up and over handle 5 and snaps into slot 59. The rifle is now ready for a one-hand carry with the weight of the rifle pulling downward along a straight line through the arm, wrist, and hand; thus avoiding the fatigue of one-handed carry without a carrier.

While in a one-hand, unaided carry position the rifle tends to rotate about its longitudinal axis with the top moving toward the bearer. This is caused by the fingers of most people being too short to comfortably or completely reach around the carrying circumference of the rifle. Use of the hand carrier with its in-line-with-the-arm-wrist-hand position eliminates the fatigue of resisting this rotation and the fatigue of grasping the rifle with the hand opened excessively. Better and faster control is gained by having a smaller carrying circumference on handle 5 than the larger carrying circumference of the rifle, and less effort is required to reorient the muzzle of the rifle around obstacles because slippage of the carrying hand is eliminated.

Also, the hand carrier need not be removed before repeatedly aiming and discharging the rifle, and the time and number of motions required to place the rifle in aiming and firing position are the same with the carrier on or off the rifle.

To detach the hand carrier; first, without exception, carefully inspect the rifle to see that it is unloaded and that there are no obstructions in the barrel.

Next, place the rifle with its longitudinal axis approximately parallel to the chest of the user and the bottom of the rifle against a firm horizontal surface. Carefully place one hand in a transverse squeezing position across the top of front section 11, and place the other hand in a transverse squeezing position across the top of back section 12. At this point squeeze front section 11 and back section 12 until straight-line section 13 can be pushed vertically by tips of both first fingers to clear slot 59. Release the squeezing action to permit straight-line section 13 to ride up and over handle 5, thereby opening the carrier and allowing the removal of the carrier from the rifle or the rifle from the carrier. Now, without adjustment, the carrier may be transferred to another rifle or user.

These procedures for attaching and detaching the hand carrier may be varied to suit the circumstances and skill of the user. However, the safety inspections ensuring that firearms are unloaded and barrels are unobstructed must always be done.

Accordingly, it is seen that the hand carrier of this invention is used to carry a long arm firearm with reduced fatigue and improved control. Further, it will permit carry for a longer period of time in a quickly accessible position and allow aiming and discharge of the firearm immediately. Also, the hand carrier will stay in place on the firearm during repeated aiming and discharging. In addition, it reduces snagging of impediments along the route of carry, it can be used while a conventional sling is attached, and it does not interfere with back or other packs.

The handle can be made of wood, plastic or other materials; waterproofed, colored (or otherwise decorated); changed in shape, dimensions, and texture. The cradle may be made of spring steel, other metals, or composites. The cradle legs, bends, and members may be changed in dimensions; the sleeves of the front and back members may be made of rubber, plastic or other materials, made in different colors; and changed in dimensions.

Although the description above contains much specificity, this should not be construed as limiting the scope of the invention, but as merely providing illustrations of one of the presently preferred embodiments of this invention. For example, the members and bends of the grasping cradle may be altered in dimensions to better fit certain types and groups of long arm firearms.

Although preferred embodiments of the hand carrier have been shown and described above, the invention is not limited to these specific embodiments, but rather the scope of the invention is to be determined as claimed.

What is claimed is:

1. A carrier for a long arm firearm, the carrier having an open position and a closed position, comprising a handle and a single strand of wire bent to form two saddles to grip and support a firearm and having a straight-line section and an open section, the open section of the wire being remove ably attached to the handle, wherein the handle has a longitudinal slot to receive the straight-line section of the wire to provide the closed position and wherein the open section has two legs with each leg extending toward the other along a centerline and terminating at an end of the wire, the handle is cylindrically-shaped and has a first shelf at each end to support the wire near the open section, and a hole at each end to receive a leg of the open section at each end of the handle.

2. A carrier in accordance with claim 1 further comprising a bushing at each end of the handle centered on the center line of the handle engaging a portion of the wire near the open section to hold the leg of the open section at each end of the handle in the respective receiving hole.

3. A carrier in accordance with claim 2 further comprising a washer at each end of the handle, each washer having a diameter greater than the diameter of the bushing and centered on the center line of the handle, each washer being on the side of the bushing away from the wire and pushing against a bushing when in place, and a screw at each end of the handle centered on the center line of the handle that holds the washer and bushing in place when screwed into the handle.

4. A carrier in accordance with claim 3 further comprising a tubular member on each saddle formed in the wire.

5. A carrier for a long arm firearm comprising a wire bent to cradle and hold the firearm in a position to be carried by one hand, the wire having an open section and a straight-line section, and a cylindrical handle attached to the open section of the wire and having a longitudinal slot along a chord of the circular cross-section of the handle to receive the straight-line section of the wire, the handle further having at each end a first shelf to support the wire near the open section and a second longitudinal shelf extending from the slot along the chord of the handle on which the bottom surface of the slot is located.

6. A carrier in accordance with claim 5 wherein the handle has a third shelf on the same chord as the second shelf for supporting a portion of the wire near the straight-line section and wherein the washer at each end guides the wire of the straight-line section onto the second shelf and into the slot.

* * * * *